US010995759B2

(12) United States Patent
Pae et al.

(10) Patent No.: US 10,995,759 B2
(45) Date of Patent: May 4, 2021

(54) WATER PUMP

(71) Applicant: COAVIS, Sejong-si (KR)

(72) Inventors: Wan Sung Pae, Sejong-si (KR); Hyun Tae Lee, Sejong-si (KR); Byeung Jin Kim, Daejeon (KR)

(73) Assignee: COAVIS, Sejong-Si (KR)

( * ) Notice: Subject to any disclaimer, the term of this patent is extended or adjusted under 35 U.S.C. 154(b) by 0 days.

(21) Appl. No.: 16/816,694

(22) Filed: Mar. 12, 2020

(65) Prior Publication Data

US 2020/0300264 A1 Sep. 24, 2020

(30) Foreign Application Priority Data

Mar. 19, 2019 (KR) ..... 10-2019-0031305

(51) Int. Cl.
*F04D 13/06* (2006.01)
*F04D 29/42* (2006.01)
(Continued)

(52) U.S. Cl.
CPC ..... *F04D 13/0633* (2013.01); *F04D 13/025* (2013.01); *F04D 13/026* (2013.01);
(Continued)

(58) Field of Classification Search
CPC ..... F04D 13/026; F04D 13/0606; F04D 13/0633; F04D 29/026; F04D 29/043;
(Continued)

(56) References Cited

U.S. PATENT DOCUMENTS 3,220,349 A * 11/1965 White ..... F04D 29/0416 417/357
4,047,847 A * 9/1977 Oikawa ..... F04D 13/025 417/370
(Continued)

FOREIGN PATENT DOCUMENTS

JP 59180002 A 10/1984
KR 20110022919 A 3/2011
(Continued)

OTHER PUBLICATIONS

Korean Office Action for Application No. 10-2019-0031305 dated Mar. 12, 2020.

*Primary Examiner* — Peter J Bertheaud
(74) *Attorney, Agent, or Firm* — Nixon Peabdoy LLP; Thomas P. Pavelko

(57) ABSTRACT

Provided is a water pump including a lower casing, an upper casing coupled to an upper side of the lower casing to form an impeller accommodating space therein by the coupling with the lower casing and having an inlet communicating with the impeller accommodating space and allowing a fluid to be introduced therethrough and an outlet allowing the fluid to be discharged therethrough, an impeller provided in the impeller accommodating space and including an upper plate and a lower plate arranged to be spaced apart from each other vertically and a plurality of blades arranged and coupled between the upper plate and the lower plate, and a rotor coupled to the impeller and rotated together with the impeller, wherein the upper casing has a spacing recess provided on an inner surface corresponding to an outer circumference of the upper plate of the impeller.

6 Claims, 8 Drawing Sheets

(51) Int. Cl.

| | |
|---|---|
| ***F04D 29/046*** | (2006.01) |
| ***F04D 29/043*** | (2006.01) |
| ***F04D 13/02*** | (2006.01) |
| ***F04D 29/62*** | (2006.01) |
| ***F04D 29/02*** | (2006.01) |
| ***F04D 29/66*** | (2006.01) |
| ***F04D 29/22*** | (2006.01) |
| *F04D 1/00* | (2006.01) |

(52) U.S. Cl.
CPC ..... *F04D 13/06* (2013.01); *F04D 13/0606* (2013.01); *F04D 13/0666* (2013.01); *F04D 29/026* (2013.01); *F04D 29/043* (2013.01); *F04D 29/046* (2013.01); *F04D 29/22* (2013.01); *F04D 29/426* (2013.01); *F04D 29/628* (2013.01); *F04D 29/669* (2013.01); *F04D 1/00* (2013.01)

(58) Field of Classification Search
CPC .... F04D 13/06; F04D 13/0666; F04D 13/025; F04D 29/426; F04D 29/669; F04D 29/046; F04D 29/628; H02K 5/128
See application file for complete search history.

(56) References Cited

U.S. PATENT DOCUMENTS

| | | | | |
|---|---|---|---|---|
| 4,722,661 | A * | 2/1988 | Mizuno | F04D 13/026 310/106 |
| 4,806,080 | A * | 2/1989 | Mizobuchi | C04B 35/486 417/353 |
| 5,248,245 | A * | 9/1993 | Behnke | F04D 29/061 415/110 |
| 6,056,520 | A * | 5/2000 | Nguyen | F04D 7/02 417/420 |
| 6,445,098 | B1 * | 9/2002 | Materne | F04D 13/0626 310/418 |
| 8,353,687 | B2 * | 1/2013 | Werson | H02K 21/24 417/423.1 |
| 2016/0025095 | A1 * | 1/2016 | Hattori | F04D 13/06 417/423.12 |

FOREIGN PATENT DOCUMENTS

| | | | |
|---|---|---|---|
| KR | 101502285 | B1 | 3/2015 |
| KR | 20150052436 | A | 5/2015 |

* cited by examiner

WATER PUMP

CROSS-REFERENCE TO RELATED APPLICATIONS

This application claims priority under 35 U.S.C. § 119 to Korean Patent Application No. 10-2019-0031305, filed on Mar. 19, 2019, in the Korean Intellectual Property Office, the disclosure of which is incorporated herein by reference in its entirety.

TECHNICAL FIELD

The following disclosure relates to a water pump for force-feeding (supplying or transporting) a fluid by rotating an impeller.

BACKGROUND

Water pumps are devices for circulating a coolant to an engine or a heater to cool the engine or heat a room. These water pumps are classified into mechanical water pumps and electric water pumps.

The mechanical water pump is a pump connected to a crankshaft of the engine and driven according to the rotation of the crankshaft and the electric water pump is a pump driven by rotation of a motor controlled by a control device.

FIGS. 1 and 2 are an exploded perspective view and a front cross-sectional view showing an electric water pump of a related art.

Referring to FIGS. 1 and 2, the electric water pump of the related art includes a housing 10, a stator 20, a can 30, a rotor 40, a rotating shaft 41, a lower bearing 42, an upper bearing 43, an impeller 50 and an upper casing 60.

More specifically, the stator 20 is provided in the housing 10 having a concave accommodating space, a protrusion 31 protruding downward from the can 30 is inserted to pass through a central portion of the stator 20, and an upper portion of the can 30 is coupled to an upper end of the housing 10. An inside of the protrusion 31 of the can 30 has a concave space in which the rotor 40 is disposed, and both ends of the rotating shaft 41 coupled to the rotor 40 are coupled to and supported by the lower bearing 42 and the upper bearing 43. In addition, the upper casing 60 is coupled to an upper side of the can 30 so that the impeller 50 is provided in an internal space formed as the can 30 and the upper casing 60 are coupled, and the impeller 50 is coupled to the rotating shaft 1 and rotated together with the rotor 40. Accordingly, a fluid flowing into an inlet pipe 61 formed at the upper casing 60 according to rotation of the impeller 50 is boosted through the impeller 50 and then discharged through an outlet pipe 62 formed at the upper casing 60.

However, since the impeller 50 and the rotor 40 are rotatably supported by the bearings, there is a gap for the rotating shaft 41 of the rotor 40 to move in radial and axial directions. In addition, a position of the impeller 50 is moved or the impeller 50 is inclined by a pressure of the fluid, while the fluid is being force-fed by the rotation of the impeller 50, and thus the upper casing 600 wears as an outer circumferential edge of the impeller 50 comes into contact with an inner surface of the upper casing 60 surrounding the impeller 50. As a result, noise and vibration may occur, and the fluid may be leaked to the worn portion, thereby degrading performance of the water pump.

RELATED ART DOCUMENT

Patent Document

KR 10-2015-0052436 A (2015 May 14)

SUMMARY

An exemplary embodiment of the present invention is directed to providing a water pump in which frictional contact between an outer circumferential edge portion of an impeller and an inner surface of an upper casing is prevented, thereby preventing wearing and breakage of the upper casing and the impeller, preventing noise and vibration, and preventing a degradation of performance.

In one general aspect, a water pump includes: a lower casing; an upper casing coupled to an upper side of the lower casing to form an impeller accommodating space therein by the coupling with the lower casing and having an inlet communicating with the impeller accommodating space and allowing a fluid to be introduced therethrough and an outlet allowing the fluid to be discharged therethrough; an impeller provided in the impeller accommodating space and including an upper plate and a lower plate arranged to be spaced apart from each other vertically and a plurality of blades arranged and coupled between the upper plate and the lower plate; and a rotor coupled to the impeller and rotated together with the impeller, wherein the upper casing may have a spacing recess provided on an inner surface corresponding to an outer circumferential edge of the upper plate of the impeller.

The upper casing may have a concave upper mounting recess to cover an upper surface and an outer circumferential surface of the upper plate of the impeller, and the spacing recess may be provided to be concave on an upper wall of the mounting recess.

The upper wall of the mounting recess of the upper casing may be spaced apart from the upper plate of the impeller in parallel.

A length of the spacing recess may be within a range of 1/18 to 1/12 of a length of the upper plate.

The spacing recess may have a cross-section in one of a rounded shape, a triangular shape, and an angular shape.

The water pump may further include a rotor accommodating part having a concave container shape integrated with the lower casing, and the rotor may be provided in the rotor accommodating part.

The lower casing may have a lower bearing mounting portion provided at the rotor accommodating part to allow a lower bearing to be coupled thereto, the upper casing may have an upper bearing mounting portion to allow an upper bearing to be coupled thereto, and opposing ends of a rotating shaft of the rotor may be coupled to and supported by the lower bearing and the upper bearing.

The lower bearing and the upper bearing may each include a bushing supporting a radial direction of the rotating shaft and a support pin supporting an axial direction of the rotating shaft.

The water pump may further include: a stator coupled to an outside of the rotor accommodating part; and a housing coupled to a lower side of the lower casing to accommodate the stator therein.

Other features and aspects will be apparent from the following detailed description, the drawings, and the claims.

DETAILED DESCRIPTION OF EXEMPLARY EMBODIMENTS

Hereinafter, a water pump according to exemplary embodiments will be described in detail with reference to the accompanying drawings.

Figure 1:
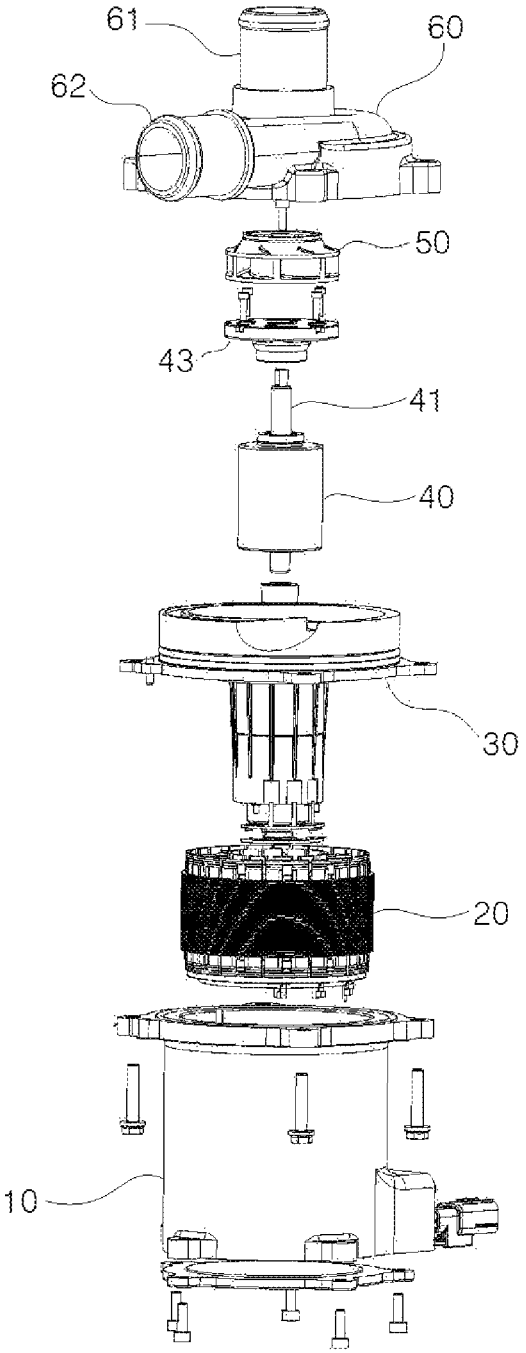
FIG. 1 Prior Art
FIGS. 1 and 2 are an exploded perspective view and a front cross-sectional view showing the electric water pump of the related art.
Figure 2:
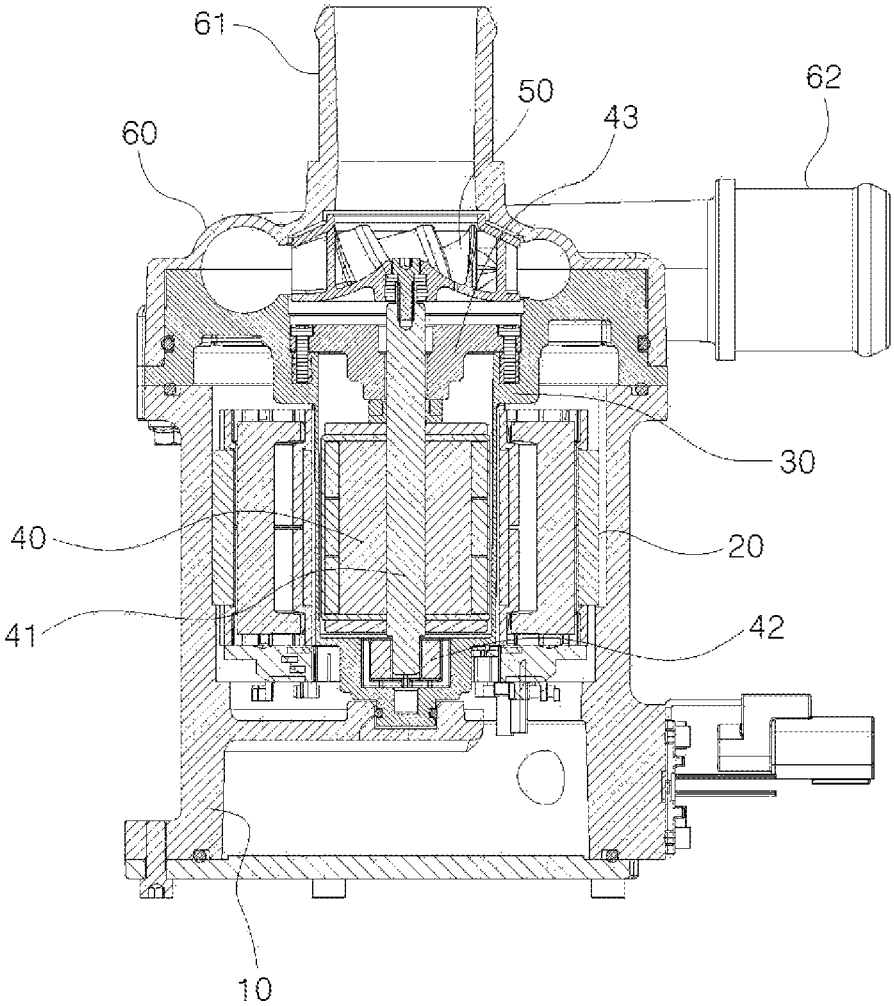
FIG. 2 Prior Art
Figure 3:
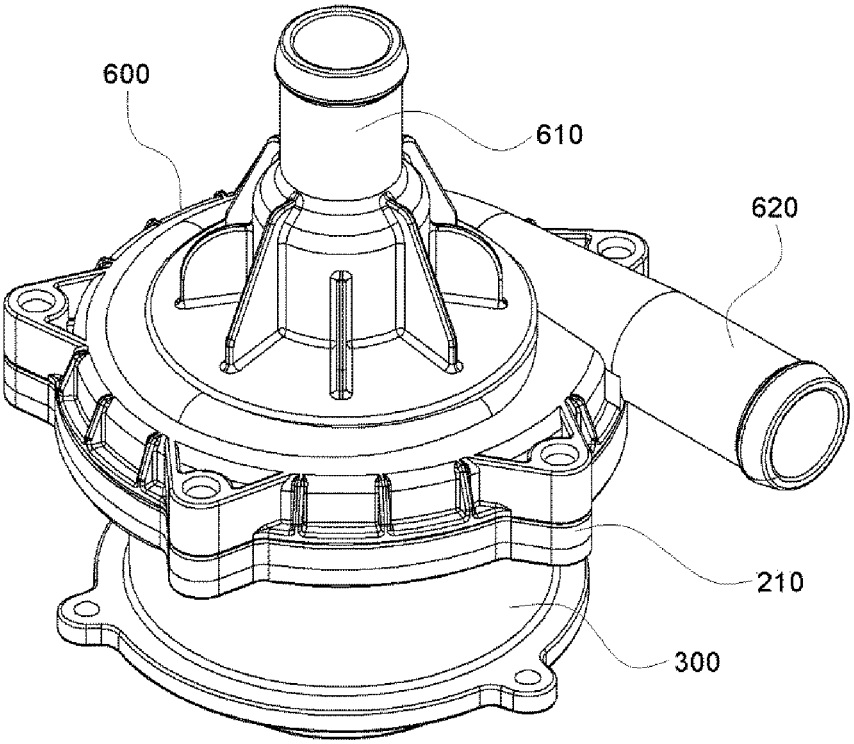
FIGS. 3 through 5 are an assembled perspective view, an exploded perspective view, and a front cross-sectional view showing a water pump according to an exemplary embodiment of the present invention.
Figure 4:
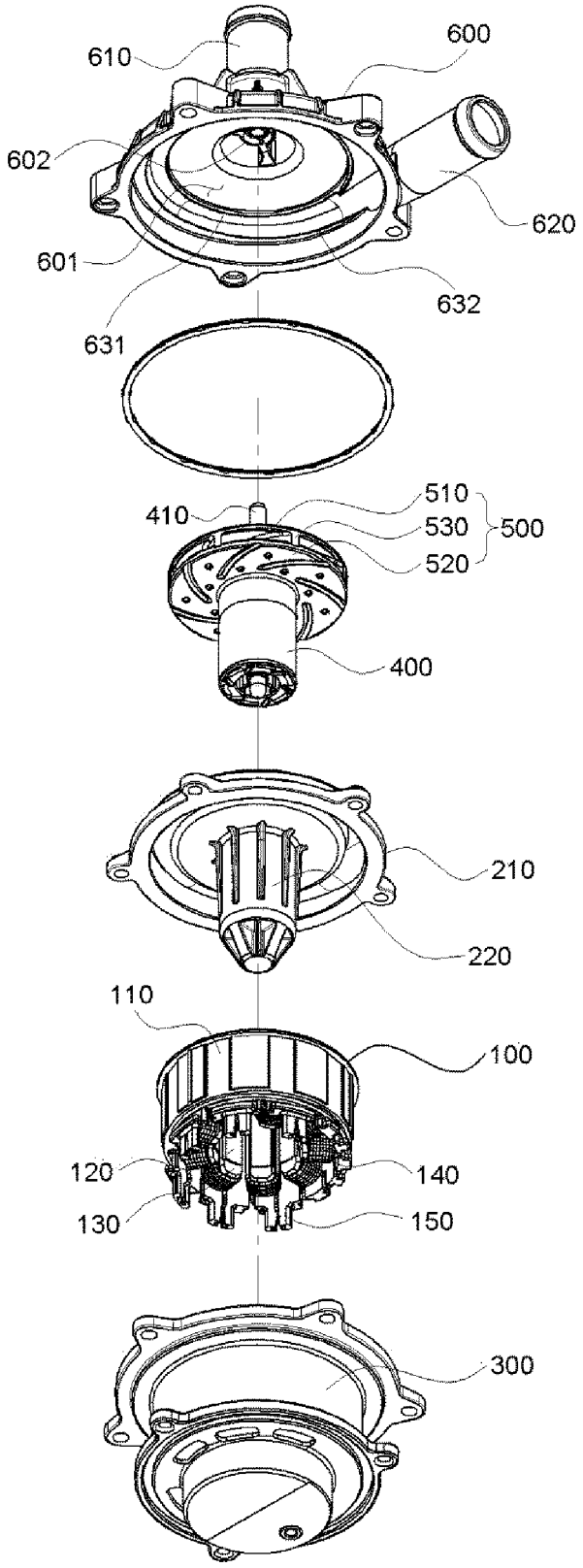
Figure 5:
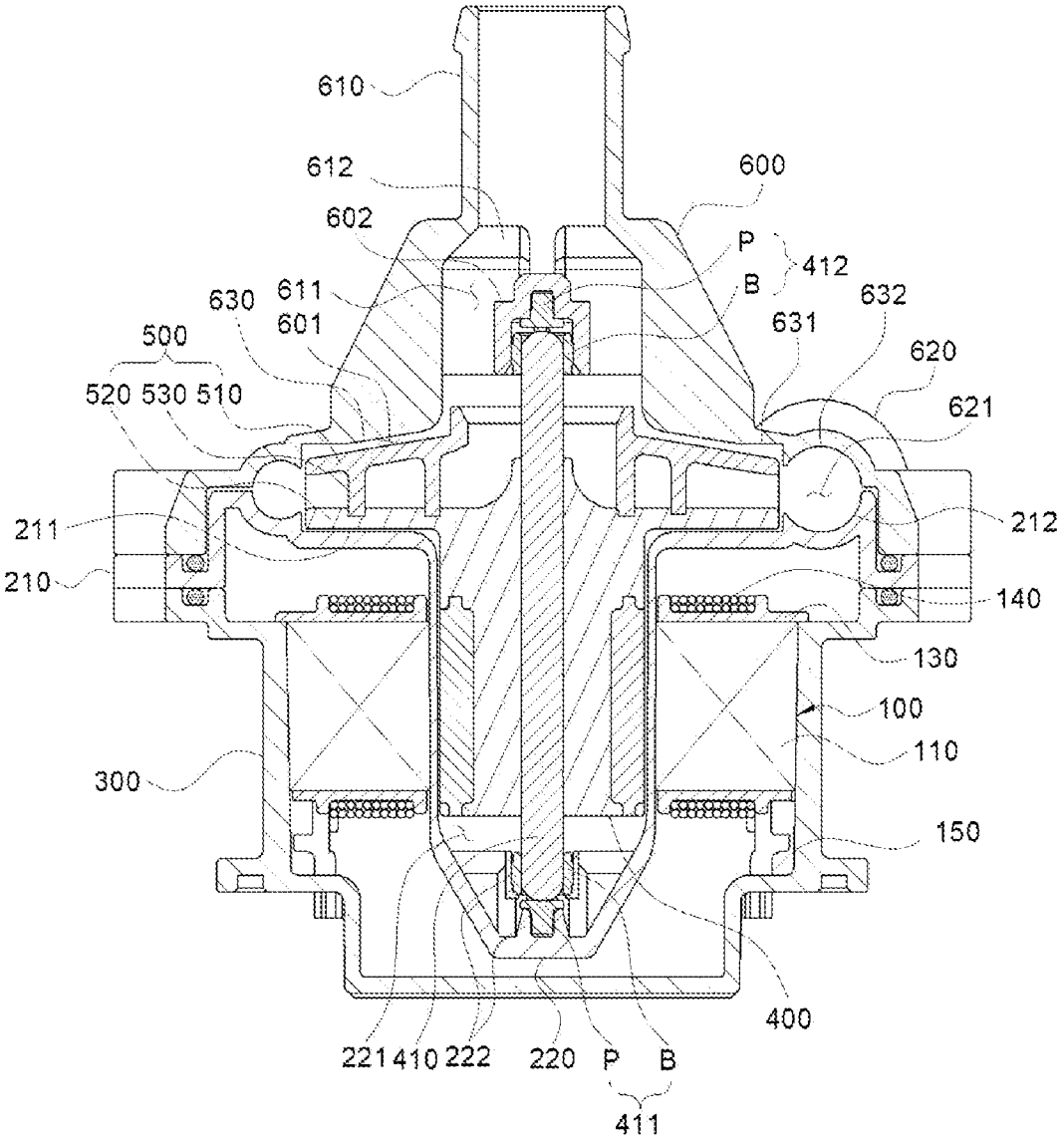
Figure 6:
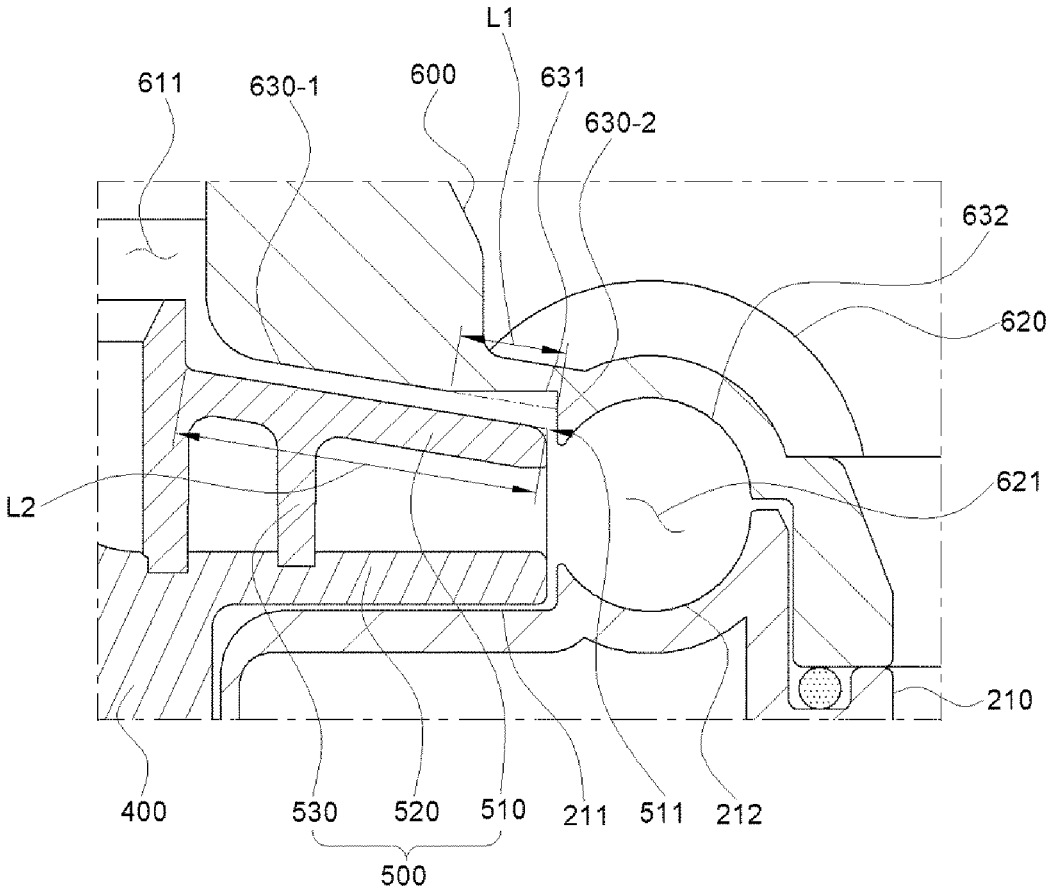
FIG. 6 is a partial, enlarged view showing a spacing recess of an upper casing in FIG. 5.

FIGS. 3 to 5 are an assembled perspective view, an exploded perspective view, and a front cross-sectional view showing a water pump according to an exemplary embodiment of the present invention, and FIG. 6 is a partial, enlarged view showing a spacing recess of an upper casing in FIG. 5.

Referring to FIGS. 3 to 5, a water pump according to an exemplary embodiment of the present invention may include a stator 100, a lower casing 210, a rotor accommodating part 220, a housing 300, a rotor 400, an impeller 500, and an upper casing 600.

First, the stator 100 may include a core 110, a plurality of teeth 120, an insulator 130, a coil 140, and a plurality of terminals 150. The core 110 may have a cylindrical shape, and the plurality of teeth 120 inwardly protrude from an inner circumferential surface of the cylindrical core 110 in a radial direction. In addition, the teeth 120 may be arranged to be spaced apart from each other in a circumferential direction, so that the teeth 120 may be radially arranged inside the core 110. In addition, pole shoes protrude in a circumferential direction from a side surface at an inner end of the teeth 120 in the radial direction, and neighboring pole shoes may be spaced apart from each other. In addition, the radial inner ends of the teeth 120 may be spaced apart from each other in the radial direction, so that an inner side surrounded by the teeth 120 may be penetrated vertically. The insulator 130 may be formed of an electrically insulating material and coupled to the core 110 and the teeth 120 to surround and electrically insulate the core 110 and the teeth 120. As an example, as illustrated, the insulator 130 is provided on upper and lower surfaces of the core 110 and may cover upper, lower, and side surfaces of the teeth 120. In addition, the insulator 130 may cover even a portion of the pole shoes. The coil 140 is wound around the teeth 120 covered by the insulator 130, and each winding of the coil 140 may be insulated by a coating. The terminals 150 may be electrically connected to the coil 140 and coupled and fixed to the insulator 130. In addition, the rotor accommodating part 220 may pass through and be inserted in the vertically penetrated central portion of the stator 100 so that the stator 100 may be coupled in a state of being fitted to an outer side of the rotor accommodating part 220.

The lower casing 210 has a lower mounting recess 211 concave downward on an upper surface thereof to accommodate a portion of the impeller 500, and a lower flow path recess 212 may be provided concavely outside the lower mounting recess 211 in a radial direction so that a fluid discharged from the impeller 500 may flow therein.

The rotor accommodating part 220 may be integrally formed with the lower casing 210 by injection molding, and the rotor accommodating part 220 may be provided in a container shape concave at a central portion of the lower casing 210. Thus, a rotor accommodating space 221 may be provided inside the rotor accommodating part 220, and the rotor accommodating part 220 may protrude downward convexly from a lower surface of the lower casing 210. The rotor accommodating part 220 may have a lower bearing mounting portion 222 formed at a lower bottom portion of the rotor accommodating space 221 so that the lower bearing 411 may be coupled to the lower bearing mounting portion 222. Here, the lower bearing 411 may include a bushing B capable of supporting a lower end of the rotating shaft 410 of the rotor 400 in a radial direction and a support pin P capable of supporting a lower end of the rotating shaft 410 in the axial direction.

The housing 300 is coupled to a lower side of the lower casing 210 and accommodates the stator 100 therein. Here, a radial inner side of the stator 100 may be fitted and firmly coupled to the rotor accommodating part 220, and a radial outer side of the stator 100 may be inserted and firmly coupled to the inside of the housing 300. The housing 300 may have holes vertically penetrating through a lower end thereof, through which the terminal 150 of the stator 100 may be drawn out of the housing 300, and a gap between the terminal 150 and the holes may be sealed with a sealing member or the like.

The rotor 400 is inserted into and disposed in the rotor accommodating space 221 which is the inside of the rotor accommodating part 220, and an outer circumferential surface of the rotor 400 is spaced apart from an inner circumferential surface of the rotor accommodating part 220. In the rotor 400, a lower end of the rotating shaft 410 is coupled to the lower bearing 411 and an upper end thereof is coupled to the upper bearing 412 adjacent to the upper casing 600, so that the rotor 400 may be smoothly rotated.

The upper casing 600 is coupled to an upper side of the lower casing 210, and an impeller accommodating space 610 in which the impeller 500 may be accommodated may be formed by combination of the upper casing 600 and the lower casing 210. An upper mounting recess 630 is provided on a lower surface of the upper casing 600 and is concave upward to accommodate a portion of the impeller 500, and the lower mounting recess 211 and the upper mounting recess 630 form an impeller accommodating space 601. Also, an upper flow path recess 632 may be provided concavely at a position corresponding to the lower flow path recess 212 of the lower casing 210 on a lower surface of the upper casing 600 so that the fluid discharged from the impeller 500 may flow. A central portion of the upper casing 600 may be penetrated vertically so that the upper mounting recess 630 and the inlet 610 communicate with each other, and the outlet 620 may be provided to be connected to the upper flow path recess 632 and the lower flow path recess 212. In the upper casing 600, an upper bearing mounting portion 602 may be provided inside the inlet 610 and the upper bearing 412 may be coupled to the upper bearing mounting portion 602. Here, the upper bearing mounting portion 602 may be provided at a portion where an inlet flow path 611 is provided, and the upper bearing mounting portion 602 may be fixed to supports 612 protruding from an inner circumferential surface of the inlet flow path 610 so that the fluid may smoothly pass between the supports 612 and flow toward the impeller 500. Here, the upper bearing 412 may include a bushing B supporting an upper end of the rotating shaft 410 of the rotor 400 in the radial direction and a support pin P supporting the upper end of the rotating shaft 410 in the axial direction.

The impeller 500 serves to force-feed the fluid flowing into the inlet 610 of the upper casing 600 toward the outlet 620 by rotation. The impeller 500 may include an upper plate 510, a lower plate 520, and a blade 530, and a plurality of blades 530 may be arranged and spaced apart from each other in a circumferential direction between the upper plate 510 and the lower plate 520 arranged to be spaced apart from each other vertically. A through hole vertically penetrating through both sides of the upper plate 510 is provided at a central portion of the upper plate 510, and the inside of the impeller 500 communicates with the inlet 610 of the upper casing 600 through the through hole. In addition, an outer circumferential edge of the impeller 500 may be disposed adjacent to a portion of the lower flow path recess 212 and the upper flow path recess 632 so that the fluid discharged from the impeller 500 may flow along the outlet flow path 621 formed by the flow path recesses and may be subsequently discharged through the outlet 620 of the upper casing 600. Also, for example, in the impeller 500, the lower plate 520 may be integrally formed with a core portion of the rotor 400, and the upper plate 610 and the blades 530 may be integrally formed and coupled to the lower plate 520. In addition, the impeller may be provided in various forms.

Thus, the fluid flowing into the inlet 610 of the upper casing 600 may flow into the impeller 500 through the inlet flow path 611 and the central through hole at an upper portion of the impeller 500, be boosted by a centrifugal force according to rotation of the impeller 500 to flow to the outlet flow path 621, and then flow along the outlet flow path 621 so as to be discharged to the outside through the outlet 620.

Referring to FIG. 6, the upper casing 600 may have a spacing recess 631 provided to be concave on an inner surface corresponding to the outer circumferential edge 511 of the upper plate 510 of the impeller 500. That is, the impeller 500 is coupled to the rotating shaft 410 of the rotor 400 so as to be rotated, and since there is a gap for the rotating shaft 410 to slightly move in the radial direction and the axial direction, a rolling phenomenon that a central axis is inclined as the impeller is moved upward in the axial direction by a pressure of the fluid while the fluid is forced-fed by rotation of the impeller occurs. In this case, the outer circumferential edge 511 of the upper plate 510 of the impeller 500 may be in contact with an upper wall 630-1 of the upper mounting recess 630 of the upper casing 600. However, in the present invention, the outer circumferential edge 511 of the impeller 500 does not come into contact with the upper wall 630-1 due to the spacing recess 631 provided at the upper casing 600 although the impeller 500 wobbles, thereby preventing wearing and breakage of the upper casing 600 and the impeller 500. Thus, noise and vibration may be reduced when the impeller is rotated, and leakage of the fluid from the inside of the water pump may be reduced to prevent a degradation of performance.

The upper mounting recess 630 provided in the upper casing 600 may be formed to be concave in a stepped shape to surround the upper surface and the outer circumferential surface of the upper plate 510 of the impeller 500, and the spacing recess 631 may be provided on the upper wall 630-1 of the upper mounting recess 630 and have a specific length from the end of the upper wall 630-1 connected to the side wall 630-2 toward a central axis of the impeller.

In addition, in the upper mounting recess 630 of the upper casing 600, the upper wall 630-1 may be disposed to be spaced apart from the upper plate 510 of the impeller 500 in parallel, and a length L1 of the spacing recess 631 may be within a range of 1/18 to 1/12 of a length L2 of the upper plate 510. Here, if the length of the spacing recess 631 is shorter than the above range, the noise and vibration reduction effect may be reduced and wearing and breakage may occur, and if the length of the spacing recess 631 is longer than the above range, the noise and vibration reduction effect may work and a possibility of occurrence of wearing and breakage may be reduced but leakage of the fluid through the spacing recess 631 may occur to reduce performance of the water pump. Therefore, the length of the spacing recess 631 should be provided within the range as described above to reduce noise and vibration without reducing the performance of the water pump.

Figure 7:
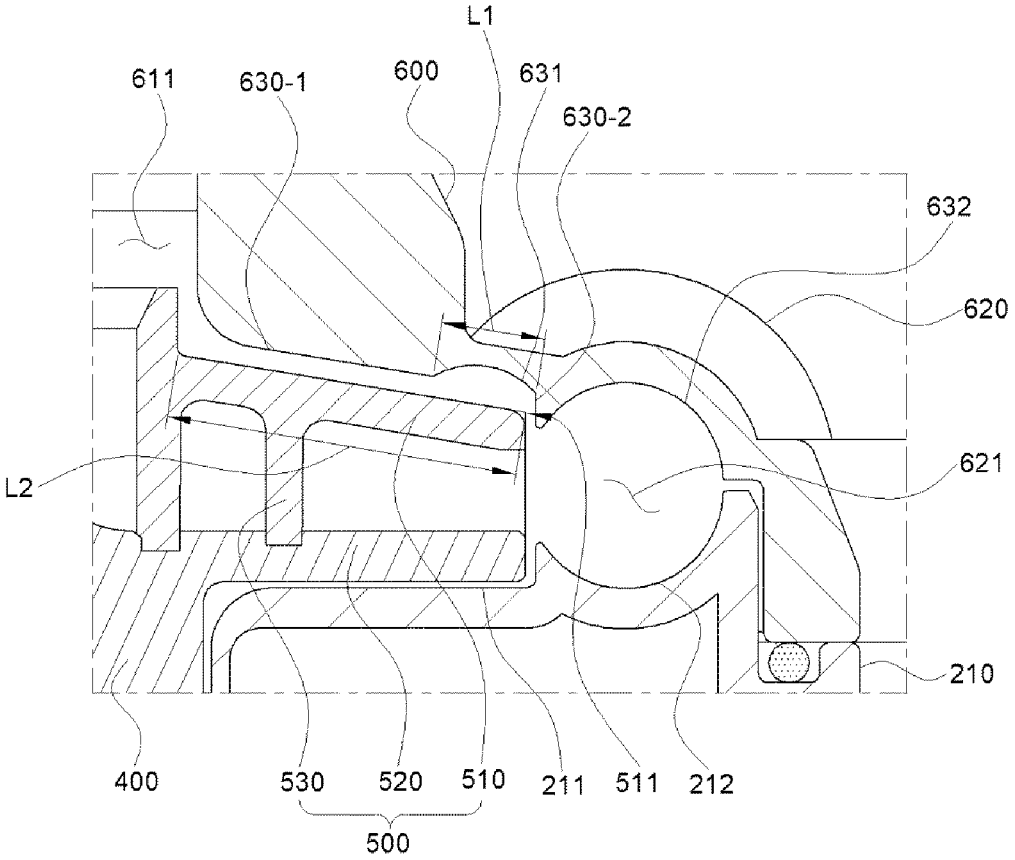
FIGS. 7 and 8 are partial, enlarged views showing examples of a spacing recess of a water pump according to an exemplary embodiment of the present invention.
Figure 8:
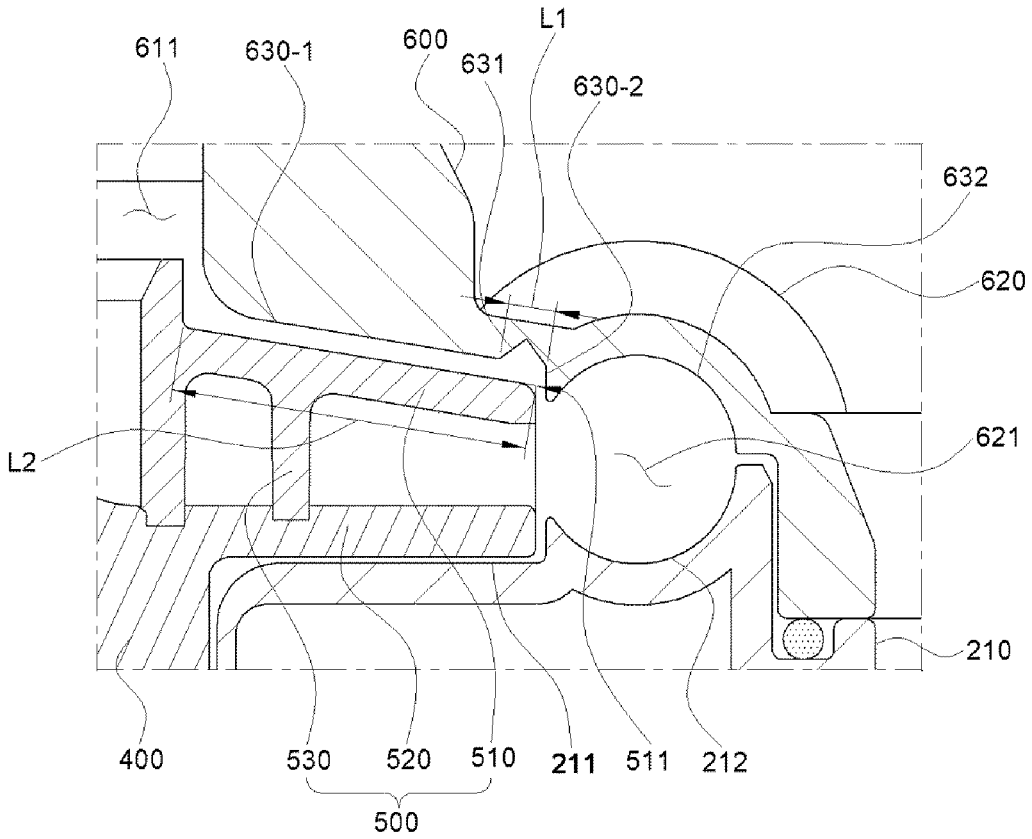

FIGS. 7 and 8 are partial, enlarged views showing examples of a spacing recess of the water pump according to an exemplary embodiment of the present invention.

Referring to FIGS. 7 and 8, the spacing recess 631 may have various shapes such as rounded, triangular, and angular shapes.

According to the water pump of the present invention, noise and vibration may be reduced when the impeller rotates, wearing and breakage of the impeller and the upper casing may be prevented, and leakage of a fluid from the inside of the water pump is reduced, thereby preventing a degradation of performance.

The present invention is not limited to the exemplary embodiments described above and may be varied in application, and it will be apparent to those skilled in the art to which the present invention pertains that modifications and variations could be made without departing from the scope of the present invention as defined by the appended claims.

[Detailed Description of Main Elements]

| | |
|---|---|
| 100: stator | |
| 110: core | 120: teeth |
| 130: insulator | 140: coil |
| 150: terminal | |
| 210: lower casing | |
| 211: lower mounting recess | 212: lower flow path recess |
| 220: rotor accommodating part | |
| 221: rotor accommodating space | 222: lower bearing mounting portion |
| 300: housing | |
| 400: rotor | 410: rotating shaft |
| 411: lower bearing | 412: upper bearing |
| B: bushing | P: support pin |
| 500: impeller | |
| 510: upper plate | 511: outer circumferential edge |
| 520: lower plate | 530: blade |
| 600: upper casing | |
| 601: impeller accommodating space | 602: upper bearing mounting portion |
| 610: inlet | 611: inlet flow path |
| 612: support | |
| 620: outlet | 621: outlet flow path |
| 630: upper mounting recess | |
| 630-1: upper wall | 630-2: side wall |
| 631: spacing recess | 632: upper flow path recess |
| L1: length of spacing recess | L2: length of upper plate |

What is claimed is:

1. A water pump comprising:

a lower casing;

an upper casing coupled to an upper side of the lower casing to form an impeller accommodating space therein by the coupling with the lower casing and having an inlet communicating with the impeller accommodating space and allowing a fluid to be introduced therethrough and an outlet allowing the fluid to be discharged therethrough;

an impeller provided in the impeller accommodating space and including an upper plate and a lower plate arranged to be spaced apart from each other vertically and a plurality of blades arranged and coupled between the upper plate and the lower plate;

a rotor coupled to the impeller and rotated together with the impeller;

a rotor accommodating part comprising a concave container shape integrated with the lower casing, with the rotor accommodated therein;

wherein the upper casing has a spacing recess provided on an inner surface corresponding to an outer circumference of the upper plate of the impeller;

the lower casing comprising a lower bearing mounting portion provided at the rotor accommodating part to allow a lower bearing to be coupled thereto;

the upper casing comprising an upper bearing mounting portion to allow an upper bearing to be coupled thereto;

opposing ends of a rotating shaft of the rotor configured to be coupled to and be supported by the lower bearing and the upper bearing; and the lower bearing and the upper bearing each comprising a bushing supporting a radial direction of the rotating shaft and a support pin supporting an axial direction of the rotating shaft.

2. The water pump of claim 1, wherein the upper casing has a concave upper mounting recess to cover an upper surface and an outer circumferential surface of the upper plate of the impeller, and the spacing recess is provided to be concave on an upper wall of the mounting recess.

3. The water pump of claim 2, wherein the upper wall of the mounting recess of the upper casing is spaced apart from the upper plate of the impeller in parallel.

4. The water pump of claim 3, wherein a length of the spacing recess is within a range of 1/18 to 1/12 of a length of the upper plate.

5. The water pump of claim 2, wherein the spacing recess has a cross-section in one of a rounded shape, a triangular shape, and an angular shape.

6. The water pump of claim 1, further comprising:

a stator coupled to an outside of the rotor accommodating part; and a housing coupled to a lower side of the lower casing to accommodate the stator therein.

* * * * *